US008469659B2

(12) United States Patent
Sakamoto et al.

(10) Patent No.: US 8,469,659 B2
(45) Date of Patent: Jun. 25, 2013

(54) TURBINE BLADE CASCADE ENDWALL

(75) Inventors: Yasuro Sakamoto, Hyogo (JP); Eisaku Ito, Hyogo (JP); Hiroyuki Otomo, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 650 days.

(21) Appl. No.: 12/670,962

(22) PCT Filed: Sep. 25, 2008

(86) PCT No.: PCT/JP2008/067326

§ 371 (c)(1),
(2), (4) Date: Jan. 27, 2010

(87) PCT Pub. No.: WO2009/093356

PCT Pub. Date: Jul. 30, 2009

(65) Prior Publication Data

US 2010/0196154 A1 Aug. 5, 2010

(30) Foreign Application Priority Data

Jan. 21, 2008 (JP) ..... 2008-010921

(51) Int. Cl.
*F04D 29/44* (2006.01)

(52) U.S. Cl.
USPC ..... 415/191

(58) Field of Classification Search
USPC ..... 415/191, 914; 416/193 A, 248
See application file for complete search history.

(56) References Cited

U.S. PATENT DOCUMENTS

| | | | | |
|---|---|---|---|---|
| 6,283,713 | B1 | 9/2001 | Harvey et al. | |
| 6,419,446 | B1 | 7/2002 | Kvasnak et al. | |
| 6,969,232 | B2 | 11/2005 | Zess et al. | |
| 2003/0170124 | A1 * | 9/2003 | Staubach et al. | 416/193 A |
| 2007/0081898 | A1 | 4/2007 | Matsuda et al. | |

FOREIGN PATENT DOCUMENTS

| | | | |
|---|---|---|---|
| JP | 11-190203 | A | 7/1999 |
| JP | 2001-065304 | A | 3/2001 |
| JP | 2004-278517 | A | 10/2004 |
| JP | 2005-133697 | A | 5/2005 |
| JP | 2006-291889 | A | 10/2006 |
| JP | 2007-247542 | A | 9/2007 |

OTHER PUBLICATIONS

Machine Translation JP 2006291889 A Koichiro et al. Oct. 26, 2006.*

(Continued)

*Primary Examiner* — Edward Look
*Assistant Examiner* — Maxime Adjagbe
(74) *Attorney, Agent, or Firm* — Westerman, Hattori, Daniels & Adrian, LLP

(57) ABSTRACT

Provided is a turbine blade cascade endwall that is capable of suppressing a vortex generated on a suction surface of a turbine stator blade and that is capable of reducing secondary-flow loss due to this vortex. A turbine blade cascade endwall that is positioned on a tip side of a plurality of turbine stator blades arranged in a ring form is provided with a pressure gradient alleviating part that alleviates a pressure gradient generated in the blade height direction at a suction surface of the turbine stator blades due to a clearance leakage flow, leaking out of a gap between a tip of a turbine rotor blade located on the upstream side of the turbine stator blades and a tip endwall disposed facing the tip of this turbine rotor blade.

6 Claims, 8 Drawing Sheets

OTHER PUBLICATIONS

Korean Office Action dated Feb. 23, 2012, issued in corresponding Korean Patent Application No. 10-2010-7003151.

International Search Report of PCT/JP2008/067326, mailing date of Nov. 11, 2008.

Decision to Grant a Patent dated Nov. 26, 2012, issued in corresponding Chinese Patent Application No. 200880103261.9, with English translation (4 pages).

Decision to Grant a Patent for KR 10-2010-7003151 dated Jan. 22, 2013. With English Translation.

The Decision to Grant a Patent has been received for KR 10-2012-7033718 dated Jan. 30, 2013.

* cited by examiner

TURBINE BLADE CASCADE ENDWALL

TECHNICAL FIELD

The present invention relates to a turbine blade cascade endwall.

BACKGROUND ART

On a turbine blade cascade endwall in a turbine serving as a motive power generator that obtains motive power by converting kinetic energy of a fluid to rotational motion, a so-called "cross flow (secondary flow)" occurs from the pressure side of one turbine blade to the suction side of an adjacent turbine blade.

In order to improve the turbine performance, it is necessary to reduce this cross flow and to reduce secondary-flow loss that occurs due to the cross flow.

Therefore, as a turbine blade cascade endwall that reduces such secondary-flow loss due to a cross flow to improve turbine performance, one having non-axisymmetric irregularities formed thereon has been known (for example, see Patent Document 1).

Patent Document 1: U.S. Pat. No. 6,283,713, Specification.

DISCLOSURE OF INVENTION

As shown in FIG. 13, on a turbine blade cascade endwall (tip endwall) 100 of turbine stator blades B, which are positioned downstream of turbine rotor blades (not shown), wherein an inflow angle (incident angle) of working fluid (for example, combustion gas) is greatly reduced due to clearance leakage flow that leaks from a gap (tip clearance) between tips of the turbine rotor blades and a tip endwall of the turbine rotor blades, for example, streamlines as shown by thin solid lines in FIG. 14 are formed, thus forming stagnation points at positions wrapping around to the suction side of the turbine stator blades B from leading edges thereof (positions along suction surfaces away from the leading edges of the turbine stator blades B towards the downstream side). Therefore, there is a problem in that a pressure gradient (pressure distribution) occurs at the suction surfaces of the turbine stator blades B in the blade height direction (vertical direction in FIG. 15), and, for example, as shown by thin solid lines in FIG. 15, a flow is induced from the tip side (outside in the radial direction: top side in FIG. 15) of the turbine stator blades B toward the hub side (inside in the radial direction: bottom side in FIG. 15), generating strong vortices (suction surface secondary flow) at the suction surfaces of the turbine stator blades, and secondary-flow loss due to these vortices increases, which causes the turbine performance to decrease.

Note that a solid line arrow in FIG. 15 indicates the flow direction of the working fluid.

The present invention has been conceived in light of the above-described situation, and an object thereof is to provide a turbine blade cascade endwall that is capable of suppressing a vortex generated on a suction surface of a turbine stator blade and that is capable of reducing secondary-flow loss due to the vortex.

In order to solve the above-described problem, the present invention employs the following solutions.

A turbine blade cascade endwall according to a first aspect of the present invention is a turbine blade cascade endwall that is positioned on a tip side of a plurality of turbine stator blades arranged in a ring form, wherein a pressure gradient alleviating part that alleviates a pressure gradient generated in the blade height direction at a suction surface of the turbine stator blades due to a clearance leakage flow, leaking out of a gap between a tip of a turbine rotor blade located on the upstream side of the turbine stator blade and a tip endwall disposed facing the tip of this turbine rotor blade, is provided.

A turbine blade cascade endwall according to a second aspect of the present invention is a turbine blade cascade endwall that is positioned on a tip side of a plurality of turbine stator blades arranged in a ring form, wherein, assuming that 0% Cax is a leading edge position of the turbine stator blades in an axial direction, that 100% Cax is a trailing edge position of the turbine stator blades in the axial direction, that 0% pitch is a position on a suction surface of the turbine stator blades, and that 100% pitch is a position on a pressure surface of a turbine stator blade facing the suction surface of the turbine stator blade, a convex portion that is gently swollen as a whole and extends substantially parallel to the axial direction, within a range from substantially −50% Cax to +50% Cax and within a range from substantially 0% pitch to substantially 50% pitch, is provided between one turbine stator blade and another turbine stator blade arranged adjacent to this turbine stator blade.

A turbine blade cascade endwall according to a third aspect of the present invention is a turbine blade cascade endwall that is positioned on a tip side of a plurality of turbine stator blades arranged in a ring form, wherein, assuming that 0% Cax is a leading edge position of the turbine stator blades in an axial direction, that 100% Cax is a trailing edge position of the turbine stator blades in the axial direction, that 0% pitch is a position on a suction surface of the turbine stator blades, and that 100% pitch is a position on a pressure surface of a turbine stator blade facing the suction surface of the turbine stator blade, a concave portion that is gently depressed as a whole and extends substantially parallel to the axial direction, within a range from substantially −50% Cax to +50% Cax and within a range from substantially 0% pitch to substantially 50% pitch, is provided between one turbine stator blade and another turbine stator blade arranged adjacent to this turbine stator blade.

A turbine blade cascade endwall according to a fourth aspect of the present invention is a turbine blade cascade endwall that is positioned on a tip side of a plurality of turbine stator blades arranged in a ring form, wherein, assuming that 0% Cax is a leading edge position of the turbine stator blades in an axial direction, that 100% Cax is a trailing edge position of the turbine stator blades in the axial direction, that 0% pitch is a position on a suction surface of the turbine stator blades, and that 100% pitch is a position on a pressure surface of a turbine stator blade facing the suction surface of the turbine stator blade, a convex portion that is gently swollen as a whole and extends substantially parallel to the axial direction, within a range from substantially −50% Cax to +50% Cax and within a range from substantially 0% pitch to substantially 50% pitch, is provided between one turbine stator blade and another turbine stator blade arranged adjacent to this turbine stator blade, and a concave portion that is gently depressed as a whole and extends substantially parallel to the axial direction, within a range from substantially −50% Cax to +50% Cax and within a range from substantially 0% pitch to substantially 50% pitch, is provided between one turbine stator blade and another turbine stator blade arranged adjacent to this turbine stator blade so as to be continuous with the convex portion, flanking the convex portion therebetween with the suction surface.

With the turbine blade cascade endwall according to the first to fourth aspects of the present invention, vortices that occur at the suction surfaces of the turbine stator blades can be suppressed, and the secondary-flow loss due to the vortices can be reduced.

A turbine according to a fifth aspect of the present invention is provided with the turbine blade cascade endwall according to one of the above-described first to fourth aspects.

With the turbine according to the fifth aspect of the present invention, because the turbine blade cascade endwall that is capable of suppressing the vortices that occur at the suction surfaces of the turbine stator blades and that is capable of reducing the secondary-flow loss due to the vortices is provided therein, the performance of the turbine as a whole can be improved.

With the present invention, an advantage is afforded in that a vortex generated in a suction surface of a turbine stator blade can be suppressed, and secondary-flow loss due to the vortex can be reduced.

BEST MODE FOR CARRYING OUT THE INVENTION

A first embodiment of a turbine blade cascade endwall according to the present invention will be described below, referring to FIGS. 1 to 3.

Figure 1:
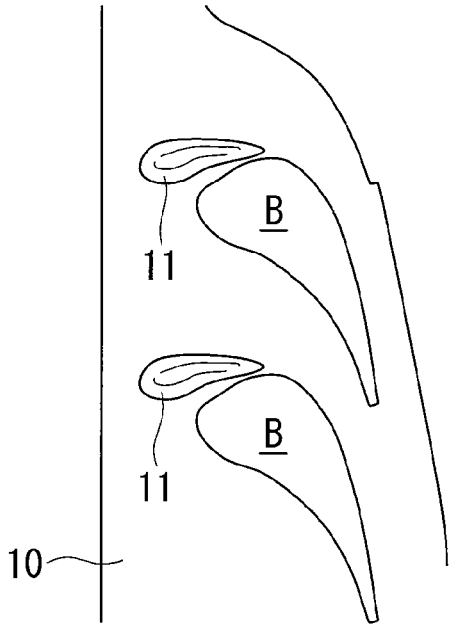
FIG. 1 is a plan view of relevant parts of turbine blade cascade endwall according to a first embodiment of the present invention.

As shown in FIG. 1, a turbine blade cascade endwall (hereinafter, referred to as "tip endwall") 10 according to this embodiment has respective convex portions (pressure gradient alleviating parts) 11 between one turbine stator blade B and a turbine stator blade B arranged adjacent to this turbine stator blade B. Note that solid lines drawn on the tip endwall 10 in FIG. 1 indicate contour lines of the convex portions 11.

The convex portion 11 is a portion that is, as a whole, gently (smoothly) swollen within a range from substantially −30% Cax to +40% Cax and within a range from substantially 0% pitch to substantially 40% pitch.

Here, 0% Cax indicates a leading edge position of the turbine stator blade B in the axial direction, and 100% Cax indicates a trailing edge position of the turbine stator blade B in the axial direction. In addition − (minus) indicates a position moved up to the upstream side in the axial direction from the leading edge position of the turbine stator blade B, and + (plus) indicates a position moved down to the downstream side in the axial direction from the leading edge position of the turbine stator blade B. Furthermore, 0% pitch indicates a position on a suction surface of the turbine stator blade B, and 100% pitch indicates a position on a pressure surface of the turbine stator blade B.

A leading-edge-side apex of the convex portion 11 is formed at a position of substantially 30% pitch in a position at substantially −20% Cax, and, from this position, a first ridge extends substantially along (substantially parallel to) the axial direction to a location at substantially −30% Cax. In addition, the height (degree of convexity) of this leading-edge-side apex of the convex portion 11 is 10% to 20% (about 10% in this embodiment) of the axial chord length of the turbine stator blade B (length of the turbine stator blade B in the axial direction).

On the other hand, a trailing-edge-side apex of the convex portion 11 is formed at a position of substantially 10% pitch in a position at substantially +20% Cax, and, from this position, a second ridge extends substantially along (substantially parallel to) the axial direction to a location at substantially +40% Cax. In addition, the height (degree of convexity) of this trailing-edge-side apex of the convex portion 11 is 10% to 20% (about 10% in this embodiment) of the axial chord length of the turbine stator blade B (length of the turbine stator blade B in the axial direction).

Furthermore, a central top portion (that is, an area positioned between the leading-edge-side apex and the trailing-edge-side apex) of the convex portion 11 is a curved surface smoothly connecting the leading-edge-side apex and the trailing-edge-side apex.

Figure 2:
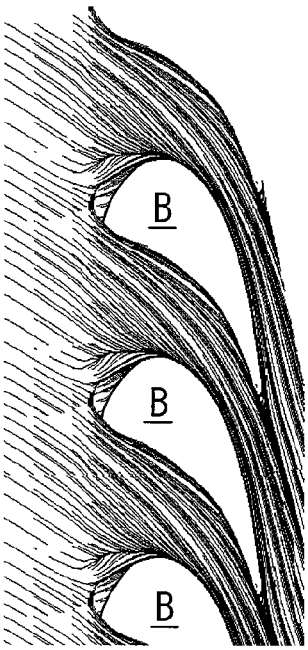
FIG. 2 is a diagram showing streamlines at the surface of the turbine blade cascade endwall shown in FIG. 1.

With the tip endwall 10 according to this embodiment, for example, streamlines as shown by thin solid lines in FIG. 2 are formed on the tip endwall 10, thus forming stagnation points at a surface on the upstream side (top side in FIG. 1) of the convex portions 11, such that stagnation points no longer form at positions wrapping around to the suction side of the turbine stator blades from leading edges thereof (positions along the suction surfaces away from the leading edges of the turbine stator blades B towards the downstream side).

Additionally, working fluid, flowing along the surface of the tip endwall 10 between surfaces on the downstream side (bottom side in FIG. 1) of the convex portions 11 and the suction surfaces of the turbine stator blades B, is accelerated when passing through between the downstream-side surfaces of the convex portions 11 and the suction surfaces of the turbine stator blades B and flows along the suction surfaces of the turbine stator blades B.

Figure 3:
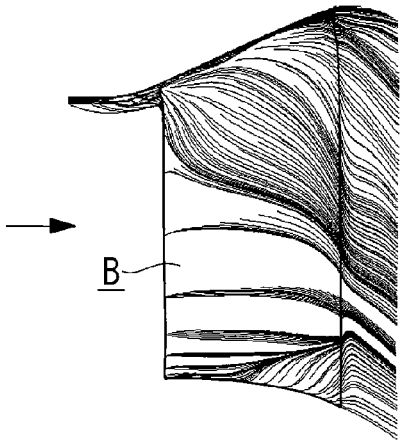
FIG. 3 is a diagram showing streamlines at a suction surface, for the turbine blade cascade endwall shown in FIG. 1.

Accordingly, a pressure gradient occurring at the suction surfaces of the turbine stator blades B in the blade height direction (vertical direction in FIG. 3) is alleviated, streamlines as shown by thin solid lines in FIG. 3, for example, can be formed on the suction surfaces of the turbine stator blades B, and vortices occurring at the suction surfaces of the turbine stator blades B can be suppressed; therefore, the secondary-flow loss due to the vortices can be reduced.

Note that a solid line arrow in FIG. 3 indicates the flow direction of the working fluid.

Figure 4:
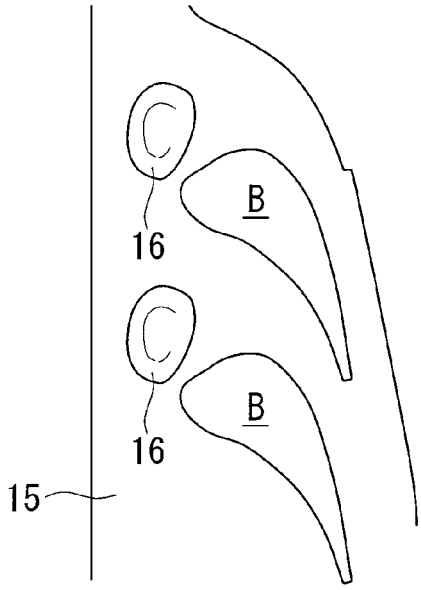
FIG. 4 is a plan view of relevant parts of a turbine blade cascade endwall similar to the turbine blade cascade endwall according to the first embodiment of the present invention.
Figure 5:
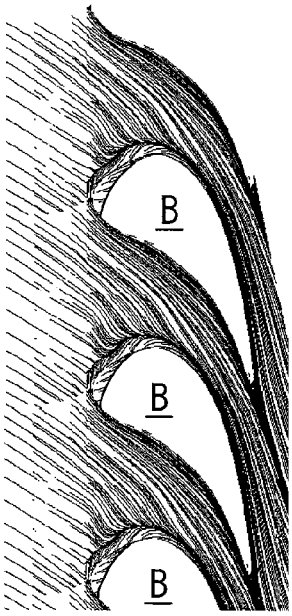
FIG. 5 is a diagram showing streamlines at the surface of the turbine blade cascade endwall shown in FIG. 4.
Figure 6:
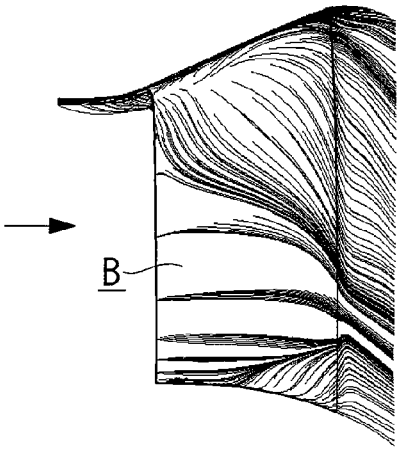
FIG. 6 is a diagram showing streamlines at a suction surface, for the turbine blade cascade endwall shown in FIG. 4.

Here, a tip endwall 15 shown in FIGS. 4 to 6 has, as in the first embodiment described above, respective convex portions 16, between one turbine stator blade B and a turbine stator blade B arranged adjacent to this turbine stator blade B. Note that solid lines drawn on the tip endwall 15 in FIG. 4 indicate contour lines of the convex portions 16.

As shown in FIG. 4, the convex portion 16 is a portion that is, as a whole, gently (smoothly) swollen within a range from substantially −30% Cax to +10% Cax and within a range from substantially 10% pitch to substantially 50% pitch.

An apex close to a leading edge of the convex portion 16 is formed at a position of substantially 20% pitch in a position at substantially −10% Cax, and, from this position, a first ridge extends substantially along (substantially parallel to) a direction perpendicular to the axial direction to a location at substantially 10% pitch. In addition, the height (degree of convexity) of this apex close to the leading edge of the convex portion 16 is 10% to 20% (about 10% in this embodiment) of the axial chord length of the turbine stator blade B (length of the turbine stator blade B in the axial direction).

On the other hand, an apex far from the leading edge of the convex portion 16 is formed at a position of substantially 40% pitch in a position at substantially −10% Cax, and, from this position, a second ridge extends substantially along (substantially parallel to) the direction perpendicular to the axial direction to a location at substantially +50% pitch. In addition, the height (degree of convexity) of this trailing-edge-side apex of the convex portion 16 is 10% to 20% (about 10% in this embodiment) of the axial chord length of the turbine stator blade B (length of the turbine stator blade B in the axial direction).

Furthermore, a central top portion (that is, an area positioned between the apex close to the leading edge and the apex far from the leading edge) of the convex portion 16 is a curved surface smoothly connecting the apex close to the leading edge and the apex far from the leading edge.

Figure 13:
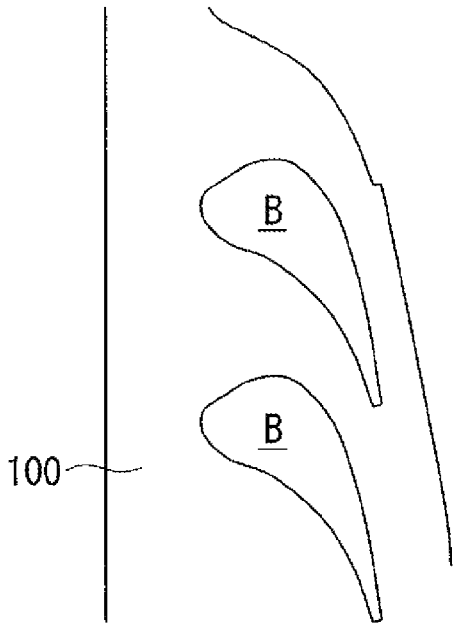
FIG. 13 is a plan view of relevant parts of a conventional turbine blade cascade endwall.
Figure 14:
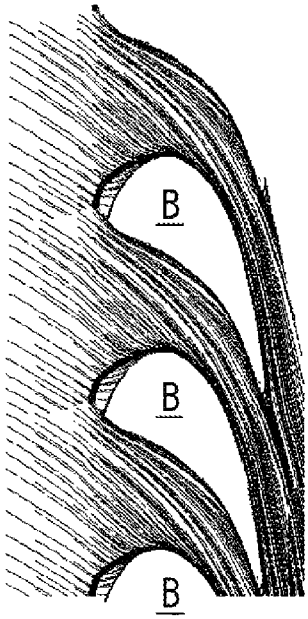
FIG. 14 is a diagram showing streamlines at the surface of the turbine blade cascade endwall shown in FIG. 13.
Figure 15:
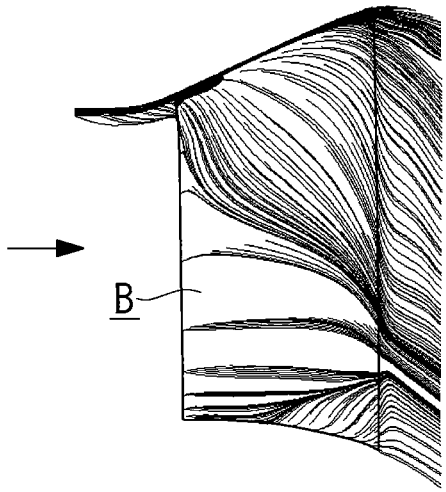
FIG. 15 is a diagram showing streamlines at a suction surface, for the turbine blade cascade endwall shown in FIG. 13.

However, with the tip endwall 15 having such convex portions 16, for example, streamlines as shown by thin solid lines in FIG. 5 are formed on the tip endwall 15, thus forming stagnation points at positions wrapping around to the suction side of the turbine stator blades B from leading edges thereof (positions along suction surfaces away from the leading edges of the turbine stator blades B towards the downstream side). Therefore, with the tip endwall 15, as in the conventional tip endwall 100 described using FIGS. 13 to 15, a pressure gradient (pressure distribution) occurs at the suction surfaces of the turbine stator blades B in the blade height direction (vertical direction in FIG. 6), and, for example, as shown by thin solid lines in FIG. 6, a flow is induced from the tip side (outside in the radial direction: top side in FIG. 6) of the turbine stator blades B toward the hub side (inside in the radial direction: bottom side in FIG. 6) thereof, generating strong vortices (suction surface secondary flow) at the suction surfaces of the turbine stator blades B, and the secondary-flow loss due to the vortices increases; consequently, the effects and advantages afforded by the first embodiment described above cannot be obtained.

A second embodiment of a tip endwall according to the present invention will be described based on FIGS. 7 to 9.

Figure 7:
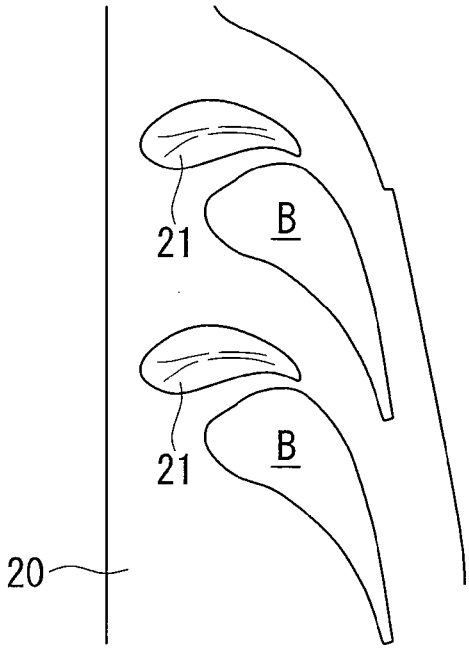
FIG. 7 is a plan view of relevant parts of a turbine blade cascade endwall according to a second embodiment of the present invention.

As shown in FIG. 7, a tip endwall 20 according to this embodiment has respective concave portions (pressure gradient alleviating parts) 21 between one turbine stator blade B and a turbine stator blade B arranged adjacent to this turbine stator blade B. Note that solid lines drawn on the tip endwall 20 in FIG. 7 indicate isobathic lines of the concave portions 21.

The concave portion 21 is a portion that is, as a whole, gently (smoothly) depressed within a range from substantially −50% Cax to +40% Cax and within a range from substantially 0% pitch to substantially 50% pitch.

Additionally, a bottom point of this concave portion 21 is formed at a position of substantially 30% pitch in a position at substantially 0% Cax. From this position, a first trough extends substantially along (substantially parallel to) the axial direction to a location at substantially −50% Cax; and, from this position, a second trough extends substantially along (substantially parallel to) the axial direction to a location at substantially +40% Cax. The depth (degree of concavity) of the bottom point of this concave portion 21 is 10% to 20% (about 10% in this embodiment) of the axial chord length of the turbine stator blade B (length of the turbine stator blade B in the axial direction).

Figure 8:
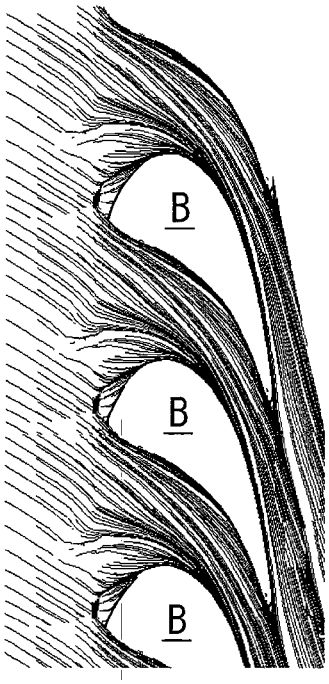
FIG. 8 is a diagram showing streamlines at the surface of the turbine blade cascade endwall shown in FIG. 7.

With the tip endwall 20 according to this embodiment, for example, streamlines as shown by thin solid lines in FIG. 8 are formed on the tip endwall 20, thus forming stagnation points at a surface on the downstream side (bottom side in FIG. 7) of the concave portions 21, such that stagnation points no longer form at positions wrapping around to the suction side of the turbine stator blades B from leading edges thereof (positions along suction surfaces away from the leading edges of the turbine stator blades B towards the downstream side).

Additionally, working fluid, flowing along the surface of the tip endwall 20 between surfaces on the downstream side (bottom side in FIG. 7) of the concave portions 21 and the suction surfaces of the turbine stator blades B, flows into the concave portions 21, is accelerated when passing between the downstream-side surfaces of the concave portions 21 and the suction surfaces of the turbine stator blades B, and flows along the suction surfaces of the turbine stator blades B.

Figure 9:
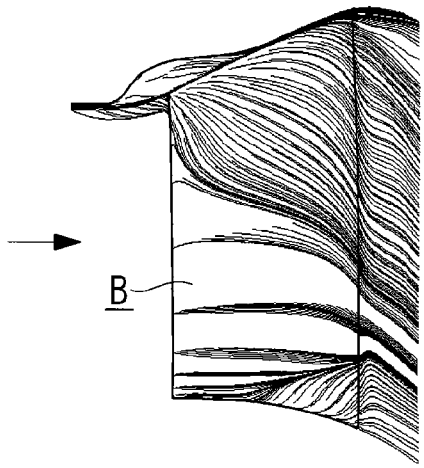
FIG. 9 is a diagram showing streamlines at a suction surface, for the turbine blade cascade endwall shown in FIG. 7.

Accordingly, a pressure gradient occurring at the suction surfaces of the turbine stator blades B in the blade height direction (vertical direction in FIG. 9) is alleviated, streamlines as shown by thin solid lines in FIG. 9, for example, can be formed on the suction surfaces of the turbine stator blades B, and vortices occurring at the suction surfaces of the turbine stator blades B can be suppressed; therefore, secondary-flow loss due to the vortices can be reduced.

Note that a solid line arrow in FIG. 9 indicates the flow direction of the working fluid.

A third embodiment of a tip endwall according to the present invention will be described based on FIGS. 10 to 12.

Figure 10:
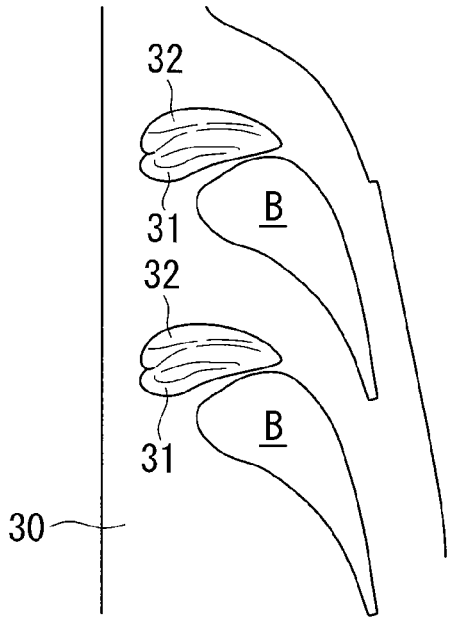
FIG. 10 is a plan view of relevant parts of a turbine blade cascade endwall according to a third embodiment of the present invention.

As shown in FIG. 10, a tip endwall 30 according to this embodiment has respective convex portions (pressure gradient alleviating parts) 31 and concave portions (pressure gradient alleviating parts) 32 between one turbine stator blade B and a turbine stator blade B arranged adjacent to this turbine stator blade B. Note that solid lines drawn on the tip endwall 30 in FIG. 10 indicate contour lines of the convex portions 31 and isobathic lines of the concave portions 32.

The convex portion 31 is a portion that is, as a whole, gently (smoothly) swollen within a range from substantially −30% Cax to +40% Cax and within a range from substantially 0% pitch to substantially 40% pitch (within a range from substantially 0% pitch to substantially 30% pitch in this embodiment).

A leading-edge-side apex of the convex portion 31 is formed at a position of substantially 20% pitch in a position at substantially −20% Cax, and, from this position, a first ridge extends substantially along (substantially parallel to) the axial direction to a location at substantially −30% Cax. In addition, the height (degree of convexity) of this leading-edge-side apex of the convex portion 31 is 10% to 20% (about 10% in this embodiment) of the axial chord length of the turbine stator blade B (length of the turbine stator blade B in the axial direction).

On the other hand, a trailing-edge-side apex of the convex portion 31 is formed at a position of substantially 10% pitch in a position at substantially +20% Cax, and, from this position, a second ridge extends substantially along (substantially parallel to) the axial direction to a location at substantially +40% Cax. In addition, the height (degree of convexity) of this trailing-edge-side apex of the convex portion 31 is 10% to 20% (about 10% in this embodiment) of the axial chord length of the turbine stator blade B (length of the turbine stator blade B in the axial direction).

Furthermore, a central top portion (that is, an area positioned between the leading-edge-side apex and the trailing-edge-side apex) of the convex portion 31 is a curved surface smoothly connecting the leading-edge-side apex and the trailing-edge-side apex.

The concave portion 32 is a portion that is, as a whole, gently (smoothly) depressed within a range from substantially −50% Cax to +40% Cax and within a range from substantially 0% pitch to substantially 50% pitch, and is provided so as to be continuous with (connected to) the convex portion 31.

Additionally, a bottom point of this concave portion 32 is formed at a position of substantially 30% pitch in a position at substantially 0% Cax. From this position, a first trough extends substantially along (substantially parallel to) the axial direction to a location at substantially −50% Cax; and, from this position, a second trough extends substantially along (substantially parallel to) the axial direction to a location at substantially +40% Cax. The depth (degree of concavity) of the bottom point of this concave portion 32 is 10% to 20% (about 10% in this embodiment) of the axial chord length of the turbine stator blade B (length of the turbine stator blade B in the axial direction).

Figure 11:
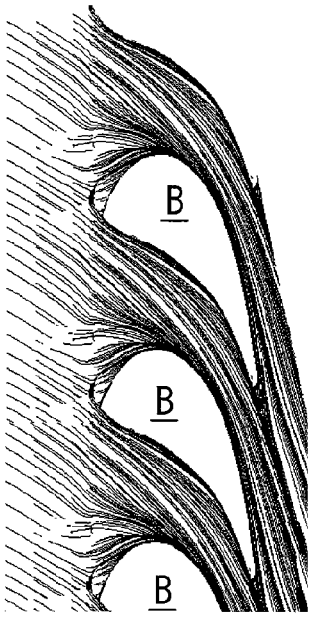
FIG. 11 is a diagram showing streamlines at the surface of the turbine blade cascade endwall shown in FIG. 10.

With the tip endwall 30 according to this embodiment, for example, streamlines as shown by thin solid lines in FIG. 11 are formed on the tip endwall 30, thus forming stagnation points over the area between surfaces on the downstream side (bottom side in FIG. 10) of the concave portions 32 and surfaces on the upstream side (top side in FIG. 10) of the convex portions 31, such that stagnation points no longer form at positions wrapping around to the suction side of the turbine stator blades B from leading edges thereof (positions along suction surfaces away from the leading edges of the turbine stator blades B towards the downstream side).

Additionally, working fluid, flowing along the surface of the tip endwall 30 between surfaces on the downstream side (bottom side in FIG. 10) of the convex portions 31 and the suction surfaces of the turbine stator blades B, is accelerated when passing between the downstream-side surfaces of the convex portions 31 and the suction surfaces of the turbine stator blades B and flows along the suction surfaces of the turbine stator blades B.

Accordingly, a pressure gradient occurring at the suction surfaces of the turbine stator blades B in the blade height direction (vertical direction in FIG. 12) is alleviated, streamlines as shown by thin solid lines in FIG. 9, for example, can be formed on the suction surfaces of the turbine stator blades B, and vortices occurring at the suction surfaces of the turbine stator blades B can be suppressed; therefore, the secondary-flow loss due to the vortices can be reduced.

Figure 12:
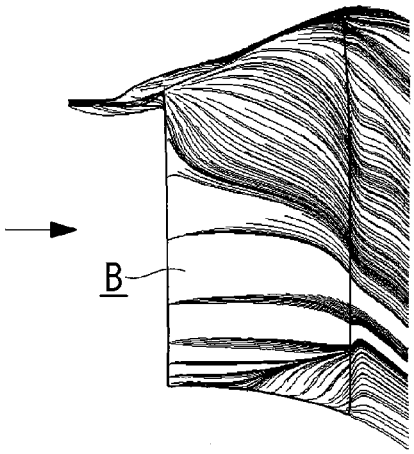
FIG. 12 is a diagram showing streamlines at a suction surface, for the turbine blade cascade endwall shown in FIG. 10.

Note that a solid line arrow in FIG. 12 indicates the flow direction of the working fluid.

Furthermore, with a turbine provided with the tip endwall according to the above-described embodiments, because the vortices that occur at the suction surfaces of the turbine stator blades are suppressed, reducing the secondary-flow loss due to the vortices, the performance of the turbine as a whole is improved.

The present invention is not limited to the embodiments described above; appropriate modifications, alterations, and combinations are possible as needed, without departing from the spirit of the present invention.

The invention claimed is:

1. A turbine blade cascade endwall that is positioned on a tip side of a plurality of turbine stator blades arranged in a ring form, wherein, assuming that 0% Cax is a leading edge position of the turbine stator blades in an axial direction, that 100% Cax is a trailing edge position of the turbine stator blades in the axial direction, that 0% pitch is a position on a suction surface of the turbine stator blades, and that 100% pitch is a position on a pressure surface of a turbine stator blade facing the suction surface of the turbine stator blade, a convex portion that is gently swollen as a whole and extends substantially parallel to the axial direction, within a range from substantially −50% Cax to +50% Cax and within a range from substantially 0% pitch to substantially 50% pitch, is provided between one turbine stator blade and another turbine stator blade arranged adjacent to this turbine stator blade, and an apex of the convex portion is formed along the axial direction within a range from substantially −20% Cax to substantially +20% Cax.

2. A turbine blade cascade endwall that is positioned on a tip side of a plurality of turbine stator blades arranged in a ring form, wherein, assuming that 0% Cax is a leading edge position of the turbine stator blades in an axial direction, that 100% Cax is a trailing edge position of the turbine stator blades in the axial direction, that 0% pitch is a position on a suction surface of the turbine stator blades, and that 100% pitch is a position on a pressure surface of a turbine stator blade facing the suction surface of the turbine stator blade, a concave portion that is gently depressed as a whole and extends substantially parallel to the axial direction, within a range from substantially −50% Cax to +50% Cax and within a range from substantially 0% pitch to substantially 50% pitch, is provided between one turbine stator blade and another turbine stator blade arranged adjacent to this turbine stator blade.

3. A turbine blade cascade endwall that is positioned on a tip side of a plurality of turbine stator blades arranged in a ring form, wherein, assuming that 0% Cax is a leading edge position of the turbine stator blades in an axial direction, that 100% Cax is a trailing edge position of the turbine stator blades in the axial direction, that 0% pitch is a position on a suction surface of the turbine stator blades, and that 100% pitch is a position on a pressure surface of a turbine stator blade facing the suction surface of the turbine stator blade, a convex portion that is gently swollen as a whole and extends substantially parallel to the axial direction, within a range from substantially −50% Cax to +50% Cax and within a range from substantially 0% pitch to substantially 50% pitch, is provided between one turbine stator blade and another turbine stator blade arranged adjacent to this turbine stator blade, a concave portion that is gently depressed as a whole and extends substantially parallel to the axial direction, within a range from substantially −50% Cax to +50% Cax and within a range from substantially 0% pitch to substantially 50% pitch, is provided between one turbine stator blade and another turbine stator blade arranged adjacent to this turbine stator blade so as to be continuous with the convex portion, flanking the convex portion therebetween with the suction surface, and an apex of the convex portion is formed along the axial direction within a range from substantially −20% Cax to substantially +20% Cax.

4. A turbine provided with the turbine blade cascade endwall according to claim 1.

5. A turbine provided with the turbine blade cascade endwall according to claim 2.

6. A turbine provided with the turbine blade cascade endwall according to claim 3.

* * * * *